US005458765A

United States Patent [19]

West

[11] Patent Number: 5,458,765

[45] Date of Patent: Oct. 17, 1995

[54] PROCESS OF DRYING AND REMOVING SOLIDS FROM WASTE OIL

[75] Inventor: Porcia E. West, Houston, Tex.

[73] Assignee: Nalco Chemical Company, Naperville, Ill.

[21] Appl. No.: 286,840

[22] Filed: Aug. 5, 1994

[51] Int. Cl.[6] ..... C10M 175/02; C10G 33/04

[52] U.S. Cl. ..... 208/180; 208/188; 208/289; 585/833

[58] Field of Search ..... 208/180, 181, 208/188, 262.1, 251 R, 289; 585/833, 836, 839

[56] References Cited

U.S. PATENT DOCUMENTS

| | | | |
|---|---|---|---|
| 3,879,282 | 4/1975 | Johnson | 208/251 R |
| 3,930,988 | 1/1976 | Johnson | 208/182 |
| 4,151,072 | 4/1979 | Nowack et al. | 208/182 |
| 5,057,207 | 10/1991 | Basler | 208/262.1 |
| 5,160,425 | 11/1992 | Lewis | 208/95 |
| 5,213,678 | 5/1993 | Rondum et al. | 208/48 AA |
| 5,288,394 | 2/1994 | Lewis et al. | 208/48 AA |

*Primary Examiner*—Asok Pal
*Assistant Examiner*—Bekir L. Yildirim
*Attorney, Agent, or Firm*—Robert A. Miller; James J. Drake

[57] ABSTRACT

This invention is a process comprising several steps for removing solid contaminants and for assisting in the dewatering of liquid hydrocarbons. For the purposes of this invention, solid contaminants include dissolved salts, either in the oil or in the emulsified water phase, or dispersed undissolved solids. First, a sample of liquid hydrocarbon containing solid contaminants is heated to a temperature in the range of 180° F.–200° F. Following heating, an aqueous solution of carbodihydrazide is added to the liquid hydrocarbon and the liquid hydrocarbon is re-heated to a temperature of 180° F. to 200° F. After re-heating, a demulsifier is added to the liquid hydrocarbon and water and the precipitated solids are separated from the liquid hydrocarbon.

10 Claims, No Drawings

PROCESS OF DRYING AND REMOVING SOLIDS FROM WASTE OIL

BACKGROUND OF THE INVENTION

1. Field of the Invention

This invention is related to the technical field of removing solids and $H_2O$ from waste oil.

2. Description of the Prior Art

Efficient reconditioning of waste oils for reuse, so-called recycling, is advantageous from both economic and ecological points of view. Use of reconditioned or recycled oils (hereafter reprocessed waste oil) as fuel or propellant is subject to governmental regulation in most countries because impurities therein may be released into the atmosphere, creating an environmental hazard. In some cases, e.g., fuel oil applications, the impurity combustion products are most hazardous. Similar problems exist in other reprocessed waste oil applications, e.g., if they are used as base oil for the manufacture of lubricant oils.

The reprocessed waste oil impurities most commonly regulated for environmental reasons include inorganic and organic compounds of metals, sulfur, phosphorus, and the halogens, in particular chlorine. Limiting the concentration of these and other impurities is particularly important when the reprocessed waste oil is to be used as base oil for manufacturing lubricant oils. Emulsified water is also a commonly found contaminant in waste oil. If not removed, it reduces the economic value of the reprocessed oil, i.e., poor product appearance, potential for corrosion in equipment. Water contents in these oils can range from 1–90% by volume. Dirt, sand inorganics, etc. are agents that stabilize oil/$H_2O$ emulsions.

One conventional method for reprocessing waste oils containing water and dissolved and undissolved solid contaminants, involves acid treatment of the waste oil followed by a separation and neutralization of the resultant acid phase, followed by neutralization and thermal treatment, in which remaining water is driven off by distillation. In certain applications the reprocessed waste oils themselves are subsequently distilled. Another conventional method is chemical treatment, i.e., demulsifiers, followed by phase separation with heat treatment.

U.S. Pat. No. 3,930,988 is directed to a method for the reduction of the ash and metals content in used lubricating oils in which the used oil is contacted with an aqueous solution of ammonium sulfate and/or ammonium bisulfate at about 93° to 260° C. and about 750 psig to react with the metal compounds present thus forming separable metal containing solids. The reaction mixture is separated into an aqueous phase containing the solids and an oil phase having reduced metals and ash contents.

U.S. Pat. No. 3,879,282 is directed to a method for decreasing the ash and lead content in used motor oils wherein the used oil is brought into contact with an aqueous solution of ammonium phosphate which forms insoluble metal salts which are allowed to settle as precipitate. Thereafter, an oil product phase is separated from the aqueous phase and precipitate.

U.S. Pat. No. 4,151,072 is directed to a method for reclaiming used lubricant oils regardless of contaminants or additive systems (impurities) contained therein, wherein, e.g., (a) used oil is contacted with an aqueous solution of an ammonium salt treating agent such as a salt selected from the group consisting of ammonium sulfate, ammonium bisulfate, ammonium phosphate, diammonium hydrogen phosphate, ammonium dihydrogen phosphate and mixtures thereof in appropriate quantities as a temperature of 60° to 120° C. (b) removing a major portion of the water and light hydrocarbons from the mixture of step (a) at a temperature of 110° to 140° C.; (c) separating the resulting oil phase by filtration; (d) heating the filtered oil phase to a temperature of 200° to 480° C. and contacting it with an adsorption agent. For some applications the resulting oil may be hydrogenated with hydrogen and a catalyst and then stripped at a temperature of 280° to 395° C.

The above-cited methods are either costly or otherwise lead to inefficient reprocessing of waste oils.

SUMMARY OF THE INVENTION

This invention is a process comprising several steps for removing solid contaminants and for assisting in the dewatering of liquid hydrocarbons. For the purposes of this invention, solid contaminants include dissolved salts, either in the oil or in the emulsified water phase, or dispersed undissolved solids. First, a sample of liquid hydrocarbon containing solid contaminants is heated to a temperature in the range of 180° F.–200° F. Following heating, an aqueous solution of carbodihydrazide is added to the liquid hydrocarbon and the liquid hydrocarbon is re-heated to a temperature of 180° F. to 200° F. After re-heating, a demulsifier is added to the liquid hydrocarbon and water and the precipitated solids are separated from the liquid hydrocarbon.

DESCRIPTION OF THE PREFERRED EMBODIMENTS

The invention comprises a process of removing solid contaminants and for assisting in the dewatering of liquid hydrocarbons. The types of liquid hydrocarbons which may be treated in this manner include paraffinic hydrocarbons found in motor oils, hydraulic fluids and cutting oils. A liquid hydrocarbon containing solid contaminants is heated to a temperature in the range of 180° F. to 200° F. Once heated, an aqueous solution of carbodihydrazide is added to the liquid hydrocarbon. A typical amount is 0.5% to 5% by volume of a 6% carbodihydrazide solution. Carbodihydrazide has the following structure:

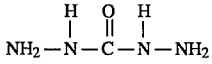

Once the carbodihydrazide solution is added to the liquid hydrocarbon, the liquid hydrocarbon is re-heated to a temperature of 180° F. to 200° F. Both steps of heating and reheating are carried out, preferably, over a period of 1 hour to 3 days. More preferably, the heating is carried out in a period of 1 hour to 16 hours. In the most preferred embodiment, the heating is carried out in a period of 4 hours to 16 hours.

Once the liquid hydrocarbon is reheated, a demulsifier is added. The demulsifier is preferably selected from the group consisting of sulfonates, ethoxylated polyols and alkyl phenol resins. Preferably, the demulsifiers used in the claimed invention include nonylphenol sulfonate, dodecyl benzene sulfonic acid, a blend of polyol esters and oxyalkylated resin in a hydrocarbon solvent, nonyl phenol resin with 45% EO on the resin, a blend of oxyalkylated polyolesters in an aromatic solvent, an alkyl aryl sulfonate, glycol 2-ethylhexanol and xylene in a hydrocarbon solvent.

Preferably, the demulsifier is added in an amount of from about 1,000 to about 12,000 parts per million (ppm). More preferably the dosage is from about 2,000 to about 10,000 ppm. In the most preferable process, the demulsifier is added in the amount of about 3,000 ppm.

Once the demulsifier has been added to the liquid hydrocarbon, the water and solid contaminants are separated from liquid hydrocarbon by any of several means. The separation may be carried out using sedimentation, which is the removal of suspended solids from a liquid by gravitational settling. The solids may further be separated by flotation. Flotation is carried out by floating light solids to the surface of a liquid-solid mixture on air bubbles and skimming off the light solids. At the same time, heavier solids are settled and removed from the bottom of the liquid-solid container. Finally, filtration and centrifugation may be used as methods of separation. Filtration comprises straining liquid/solid mixtures through a filter which removes the solids. Centrifugation is a process whereby a slurry is fed to the center of a centrifuge and then directed to an area on the outside of the centrifuge as it is spun. As the spinning motion continues, solids settle to the bottom of the outside areas. Preferably, gravity sedimentation is used as the means of separation.

EXAMPLE 1

A sample of waste oil was heated and dosed with demulsifiers only. No obvious separation of water and solids occurred. The demulsifiers used are listed in the following Table I.

TABLE I

| DEMULSIFIER/ADDITIVE | DOSAGE | COMMENTS |
|---|---|---|
| DEMULSIFIER B | 2000 PPM | NO OBVIOUS SEPARATION OF SOLIDS AND OIL AND $H_2O$ |
| DEMULSIFIER C | 2000 PPM | NO OBVIOUS SEPARATION OF SOLIDS AND OIL AND $H_2O$ |
| DEMULSIFIER D | 2000 PPM | NO OBVIOUS SEPARATION OF SOLIDS AND OIL AND $H_2O$ |
| DEMULSIFIER E | 2000 PPM | NO OBVIOUS SEPARATION OF SOLIDS AND OIL AND $H_2O$ |
| DEMULSIFIER A | 2000 PPM | NO OBVIOUS SEPARATION OF SOLIDS AND OIL AND $H_2O$ |

The following examples are presented to describe preferred embodiments and utilities of the invention and are not meant to limit the invention unless otherwise stated in the claims appended hereto.

EXAMPLE 2

A 2% aqueous solution of carbodihydrazide was added at a dosage of approximately 1200 pans per million (ppm) carbodihydrazide to the solid contaminated liquid hydrocarbon. Once added, the samples were heated. Within an hour, the solids had settled to the bottom of the sample bottle through gravity sedimentation. Subsequently a demulsifier comprised of alkyl aryl sulfonate, glycol 2-ethylhexanol and xylene in a hydrocarbon solvent (hereinafter Demulsifier A) was added and succeeded in removing water from the waste oil.

TABLE II

| DESCRIPTION | AFTER 3 DAYS SETTLING |
|---|---|
| BLANK (No CARBODIHYDRAZIDE) | HAZY-(CARAMEL BROWN COLOR (0.6% SOLIDS AT BOTTOM) |
| BLANK (0.5% CARBODIHYDRAZIDE) | CLEAR $H_2O$ AT BOTTOM 1.5% (DARKER THAN BLK. STILL HAZY) |
| BLANK (1% CARBODIRYDRAZIDE) | CLEAR $H_2O$ AT BOTTOM 2.0% (DARKER THAN BLK. STILL HAZY) |
| DEMULSIFIER A (3000 PPM 0.5% CARBODIHYDRAZIDE) | DARKER THAN BLK: STIILL HAZY - CLOUDY $H_2O$; SOLIDS SETTLING TO BOTTOM |
| DEMULSIFIER A (3000 PPM 1.0% CARBODIHYDRAZIDE) | DARKER THAN BLK. STILL SOMEWHAT HAZY; now oil has a dark brown color. |
| DEMULSIFIER A (3000 PPM - NO Carbodihydrazide) | CLEAR $H_2O$ AT BOTTOM, SOME SOLIDS FALLING TO BOTTOM; SOME AT INTERFACE 2.0% $H_2O$ |

EXAMPLE 3

A comparison was made to see if reducing the amount of carbodihydrazide would give the same effect, 300 ppm and 600 ppm of carbodihydrazide were added as described in Example 2 above. Neither lower dosage was as effective as the higher concentration of carbohydrazine (1200 ppm). Following treatment of the solid contaminated liquid hydrocarbon with the lower dosages of carbodihydrazide Demulsifier A was added and some water separation was observed.

EXAMPLE 4

A comparison was made to see if increasing the amount of carbodihydrazide from 1200 ppm to 1500 and 1800 ppm had any effect. Solids settling after subsequent demulsification were comparable to those shown at 1200 ppm carbodihydrazide. The results of this Example are shown in Table III below:

TABLE III

| | | |
|---|---|---|
| BLANK | CARAMEL BROWN HAZY COLOR | 0.25% |
| 2.5% CARBODIHYDRAZIDE 4000 PPM DEMULSIFIER A | CARAMEL BROWN HAZY COLOR | 5% $H_2O$ |
| 3.0% CARBODIHYDRAZIDE 4000 PPM DEMULSIFIER A | CARAMEL BROWN HAZY COLOR | 5.5% $H_2O$ + SOLIDS |
| 2.0% CARBODIHYDRAZIDE 3000 PPM DEMULSIFIER A | CARAMEL BROWN HAZY COLOR | 4.5% $H_2O$ + SOLIDS |
| 2.5% CARBODIHYDRAZIDE 5000 PPM DEMULSIFIER A | CARAMEL BROWN HAZY COLOR | 5% $H_2O$ |
| 3.0% CARBODIHYDRAZIDE 5000 PPM DEMULSIFIER A | CARAMEL BROWN HAZY COLOR | 5–6% |

EXAMPLE 5

A comparison was made to compare the effects of other non-ionic demulsifiers in combination with the carbodihydrazide compound. As shown in Table IV below, the addition of the non-ionic demulsifiers did not shown any improvement. It was found that the addition of the calcium salt of Dodecyl benzene sulfonic acid (DDBSA) worked best, showing excellent water separation from the oil.

TABLE IV

| | | APPEARANCE | |
|---|---|---|---|
| DESCRIPTION | GENERAL COMMENTS | % $H_2O$ SOLIDS | COMMENTS |
| BLANK - NO CARBODIHYDRAZIDE NO DE-EMULSIFIER | SAMPLES WERE PLACED IN OVEN FOR A 3-DAY PERIOD | 1% SMALL AMOUNT OF GRAY SOLIDS | OIL HAS ORIGINAL CARAMEL BROWN COLOR |
| 3% CARBODIHYDRAZIDE 4000 PPM DEMULSIFIER A | SAMPLES WERE PLACED IN OVEN FOR A 3-DAY PERIOD | 5.6% DARK COLORED SOLIDS | OIL HAS A LIGHT BROWN COLOR |
| 3% CARBODIHYDRAZIDE -4000 PPM DEMULSIFIER A -2000 PPM DEMULSIFIER F -2000 PPM DEMULSIFIER G | SAMPLES WERE PLACED IN OVEN FOR A 3-DAY PERIOD | 13% DARK COLORED SOLIDS | CLEAN OIL/$H_2O$ SEPARATION |

Changes can be made in the composition, operation and arrangement of the method of the present invention described herein without departing from the concept and scope of the invention as defined in the following claims:

I claim:

1. A process for removing solid contaminants and water from liquid hydrocarbons, consisting of:

heating a sample of liquid hydrocarbon containing solid contaminants and water to a temperature of from about 180° F. to about 200° F.;

adding a precipitating amount of an aqueous solution of carbodihydrazide to the liquid hydrocarbon;

re-heating the liquid hydrocarbon to a temperature of from about 180° F. to about 200° F. adding a demulsifier to the liquid hydrocarbon; and separating the solid contaminants and water from the liquid hydrocarbon.

2. The process of claim 1, wherein the step of heating is carried out for a time of from about 1 hour to 3 days.

3. The process of claim 2, wherein the step of heating is carried out for about 1 to 16 hours.

4. The process of claim 3, wherein the step of heating is carried out for about 4 to 16 hours.

5. The process of claim 1, wherein the step of separation is selected from the group consisting of sedimentation, flotation, filtration and centrifugation.

6. The process of claim 1, wherein the demulsifier is selected from the group consisting of sulfonates, ethoxylated polyols and alkyl phenol resins.

7. The process of claim 1, wherein the precipitating amount of carbodihydrazide comprises from about 0.5% to about 5.0% by volume of the liquid hydrocarbon solution.

8. The process of claim 6, wherein the demulsifier is added in the amount from about 1,000 to about 12,000 parts per million.

9. The process of claim 8, wherein the demulsifier is added in the amount from 2,000 to about 10,000 parts per million.

10. The process of claim 9, wherein the demulsifier is added in an amount of about 3,000 parts per million.

* * * * *